US011054218B2

(12) United States Patent
Wang et al.

(10) Patent No.: US 11,054,218 B2
(45) Date of Patent: Jul. 6, 2021

(54) ADJUSTMENT CAP ASSEMBLY AND ASSOCIATED ACCESSORIES

(71) Applicant: Forward Controls Design, Inc., Pacific Palisades, CA (US)

(72) Inventors: Roger Wang, Pacific Palisades, CA (US); Donald A. McClelland, Ogden, UT (US)

(73) Assignee: FORWARD CONTROLS DESIGN, INC., Pacific Palisades, CA (US)

( * ) Notice: Subject to any disclaimer, the term of this patent is extended or adjusted under 35 U.S.C. 154(b) by 0 days.

(21) Appl. No.: 16/675,625

(22) Filed: Nov. 6, 2019

(65) Prior Publication Data

US 2020/0149844 A1 May 14, 2020

Related U.S. Application Data

(60) Provisional application No. 62/767,103, filed on Nov. 14, 2018.

(51) Int. Cl.
*F41G 1/54* (2006.01)

(52) U.S. Cl.
CPC ..... *F41G 1/545* (2013.01)

(58) Field of Classification Search
CPC ..... F41G 1/38; F41G 1/545; F41G 1/54
USPC ..... 42/119, 122
See application file for complete search history.

(56) References Cited

U.S. PATENT DOCUMENTS 6,643,970 B2 * 11/2003 Huber ..... F41G 1/38 42/119
8,006,429 B2 * 8/2011 Windauer ..... F41G 3/06 42/122
8,270,104 B2 * 9/2012 Windauer ..... F41G 1/38 359/821

* cited by examiner

*Primary Examiner* — Reginald S Tillman, Jr.
(74) *Attorney, Agent, or Firm* — Eversheds Sutherland (US) LLP

(57) ABSTRACT

An adjustment cap assembly is provided. The adjustment cap assembly includes a disc with an top end, an opposed bottom end, and a side portion. The adjustment cap assembly includes an O-ring disposed about the disc, and a sleeve configured to secure the disc within the sleeve.

15 Claims, 9 Drawing Sheets

ADJUSTMENT CAP ASSEMBLY AND ASSOCIATED ACCESSORIES

CROSS-REFERENCE TO RELATED APPLICATIONS

This application claims priority to and the benefit of U.S. Provisional Application No. 62/767,103, filed on Nov. 14, 2018, which is incorporated by reference herein in its entirety.

FIELD OF THE DISCLOSURE

The disclosure generally relates to an adjustment cap assembly configured to adjust optic systems.

BACKGROUND

Optic adjustments can be cumbersome and meticulous mechanisms for zeroing a firearm optic. Zeroing a firearm optic generally includes making windage and elevation adjustments. Some optics, such as the AIMPOINT® line of red dot optics T1 and H1, include a proprietary adjustment tool for making windage and elevation adjustments when zeroing the optic to a firearm. In some instances, the tool is provided with the optic, but when a user is in adverse conditions and/or has limited fine tactile feel (such as when wearing gloves), the act of adjusting the optic may become quite difficult. In some instances, a user may choose to buy a separately purchased tool to adjust the optic, but this is an added expense often requiring multiple tools for different locations to have one handy at any time. The tools may still be difficult to use and/or become lost.

Accordingly, there remains a need for improving sight adjustment tools for firearm optics.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which the use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

The present disclosure provides for an adjustment cap assembly disposed on a firearm optic. Typically, a firearm optic includes an adjustment post (e.g., a raised or flush location on the firearm optic that includes a fastener, dial, or other rotatable mechanism) that zeroes the sight with the firearm. The adjustment cap assembly is configured to be securely affixed to the adjustment post. In some instances, the adjustment post includes an outer thread, and the adjustment cap assembly threadably attaches to the outer thread. The adjustment cap can provide a disc that engages an adjustment screw of the optic so as to allow adjustments via rotation of the disc without removal of the adjustment cap assembly. In this manner, the adjustment cap assembly is configured to be a fixture on the firearm optic and does not need to be removed to adjust the firearm optic.

As described herein, the adjustment cap assembly includes a disc that can be adjusted without a special tool with the manipulation of the adjustment cap assembly. For instance, the disc may include a slot suitable for engagement with an edge of a spent bullet casing, knife, screwdriver, or other engagement surface. Along with the disc, the adjustment cap assembly can include an O-ring and a threaded sleeve to slidably attach to each other. The disc, the O-ring, and the threaded sleeve are configured to engage the aforementioned adjustment post on the optic. For example, the adjustment post includes an adjustment screw set within the adjustment post, and the adjustment cap assembly threadably attaches to the adjustment post where the disc abuts the adjustment screw. The O-ring, in some embodiments, may be positioned at least partially between the threaded sleeve and disc so as to form a watertight seal when the adjustment cap assembly is secured to the adjustment post of the optic. Once the disc abuts the adjustment post, the disc can include an interface structure (e.g., an edge, a set of stubs, or other protruding surfaces extending away from the disc) for engaging the adjustment screw. For example, the interface structure may include two stubs to engage the adjustment post of an AIMPOINT® T-1 red dot optic. With other optics, the interface structure may take the form of a raised ridge or blade that interfaces with a slot in the adjustment screw.

Figure 1A:
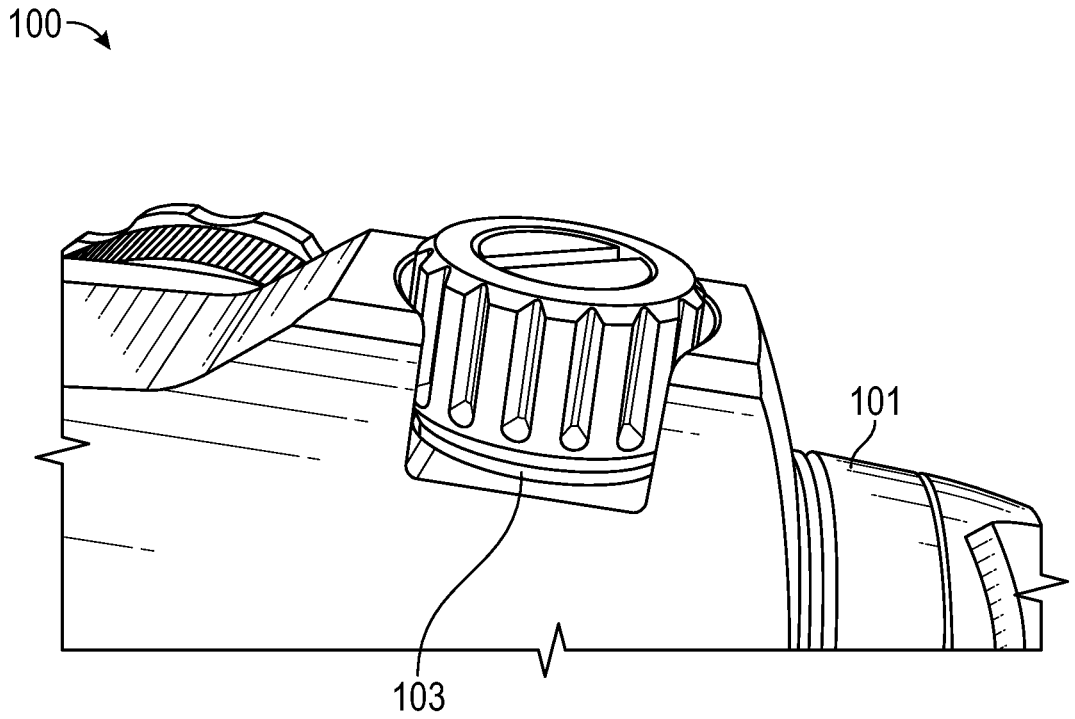
FIG. 1A is a perspective view of an adjustment cap assembly engaged with a firearm optic according to one or more embodiments of the disclosure.
Figure 1B:
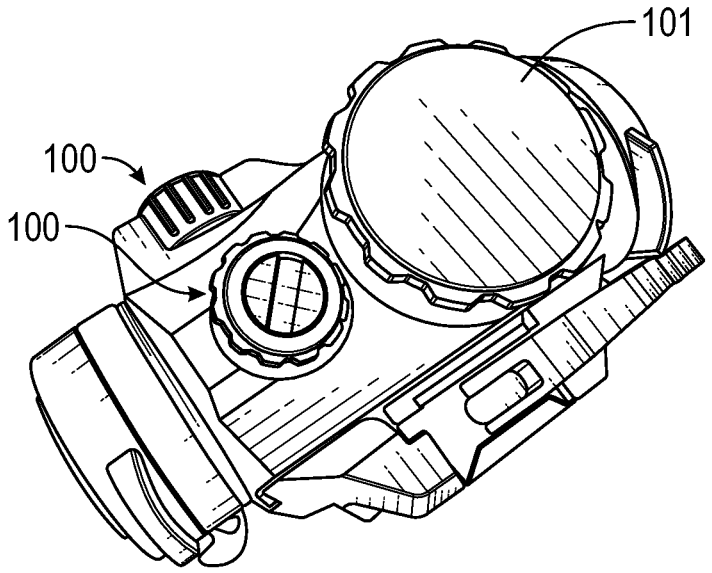
FIG. 1B is a top perspective view of the adjustment cap assembly engaged with the firearm optic according to one or more embodiments of the disclosure.
Figure 1C:
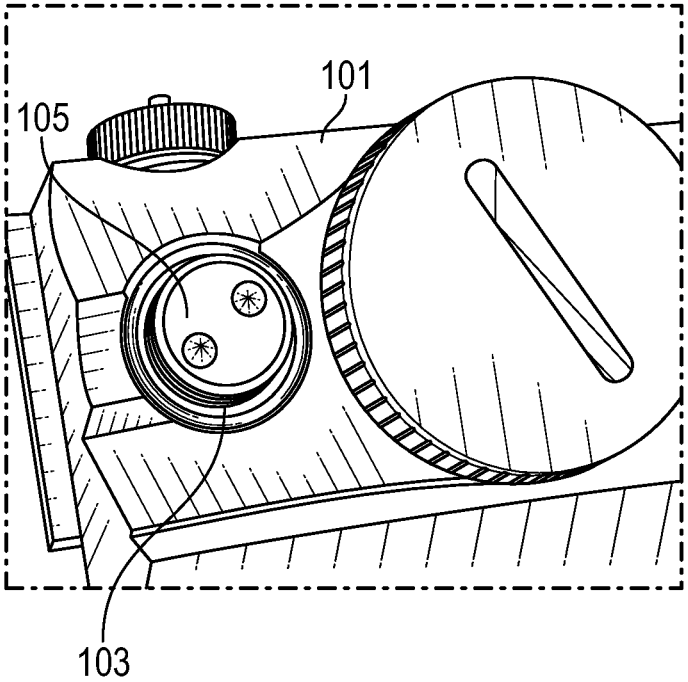
FIG. 1C is a perspective view of a firearm optic according to one or more embodiments of the disclosure.

In some embodiments, as shown in FIGS. 1A and 1B, an adjustment cap assembly 100 attached to a firearm optic 101 is provided. The adjustment cap assembly 100 can be coupled and decoupled from the firearm optic 101 via an attachment post 103 (e.g., as shown in FIG. 1C) disposed on the firearm optic 101. In some instances, the firearm optic may be an AIMPOINT® optic, including but not limited to the AIMPOINT® MICRO T-1, AIMPOINT® MICRO T-2, or other similar optics. In other instances, the firearm optic may be another type of red dot sight, fixed iron sight, or some other type of optic. As shown in FIG. 1B, the firearm optic 101 can include two or more attachment posts 103. Each attachment post may adjust the "red dot" vertically or horizontally within the firearm optic.

FIGS. 2A-2E depict various views of the adjustment cap assembly 100. The adjustment cap assembly 100 can include a disc 102 and a sleeve 104. In some embodiments, the disc 102 can slidably attach to the sleeve 104 within the sleeve 104. Together, the disc 102 and the sleeve 104 can secure onto the attachment post of the firearm optic. The adjustment cap assembly 100 can include an engagement surface 106, an inner surface 108, and an outer surface 110. In this manner, the engagement surface 106 and the outer surface 110 are opposed to an inner surface 108. The inner surface 108 can form a volume within the adjustment cap assembly 100 to receive the attachment post of the firearm optic. Accordingly, the engagement surface 106 and the outer surface 110 are outwardly disposed opposite the adjustment post of the firearm optic.

Figure 2A:
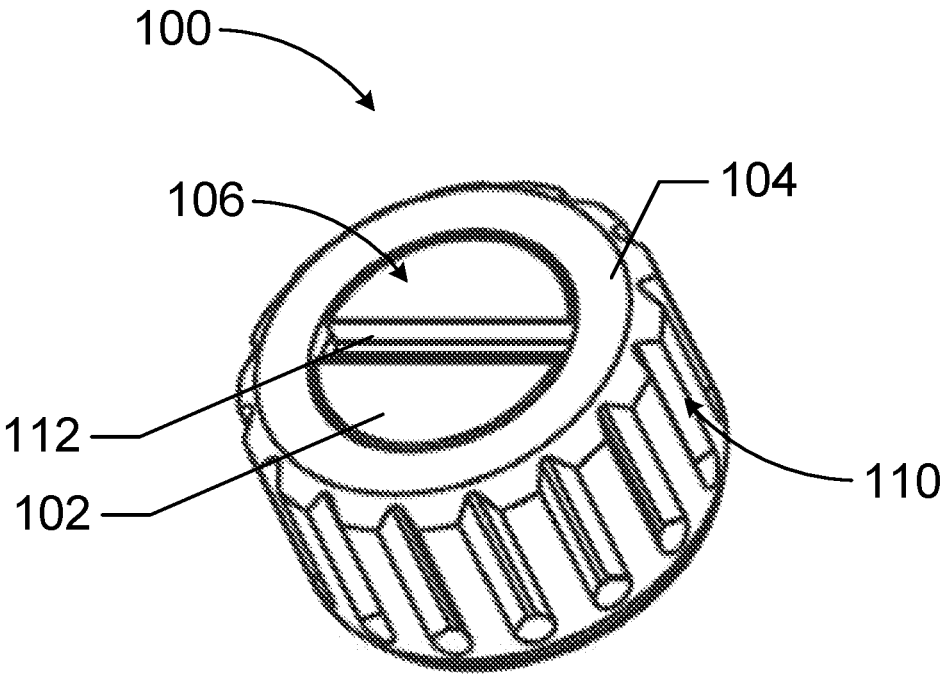
FIG. 2A is a top perspective view of an adjustment cap assembly according to one or more embodiments of the disclosure.
Figure 2B:
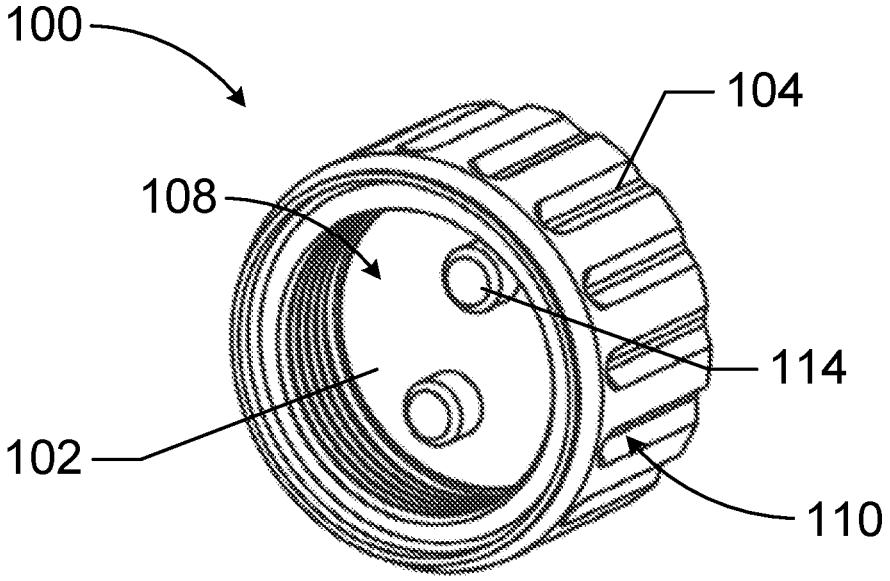
FIG. 2B is a bottom perspective view of the adjustment cap assembly according to one or more embodiments of the disclosure.
Figure 2C:
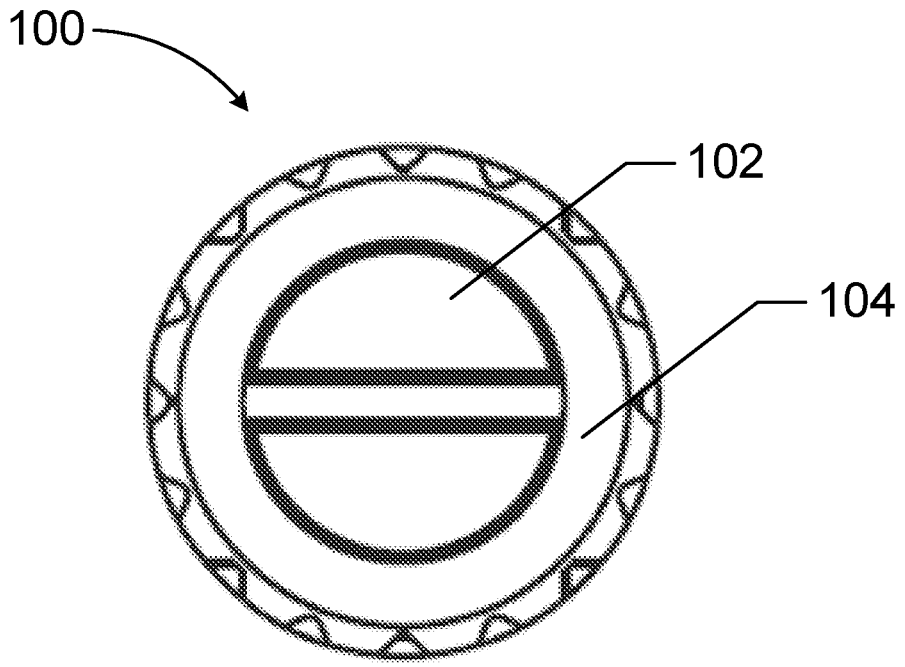
FIG. 2C is a top view of the adjustment cap assembly according to one or more embodiments of the disclosure.

As shown in FIGS. 2A and 2C, the adjustment cap assembly 100 includes a slot 112 disposed on the engagement surface 106. The slot 112 is configured to receive an edge from a tool or other component. For example, the slot 112 can include a rectangular cross-section configured to receive a screwdriver, knife, or spent bullet casing rim. The slot 112 can receive the tool to rotate the assembly cap assembly, and in turn, the adjustment mechanism on the firearm optic.

Figure 2D:
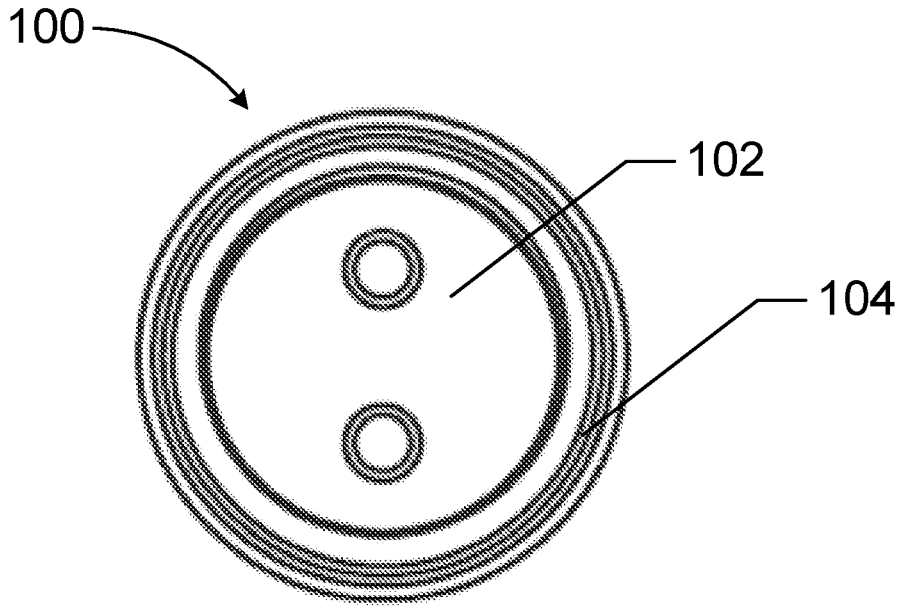
FIG. 2D is a bottom view of the adjustment cap assembly according to one or more embodiments of the disclosure.

As shown in FIGS. 2B and 2D, the adjustment cap assembly 100 includes an interface structure 114 disposed within the inner surface 108. The interface structure 114 is configured to engage the adjustment screw 105 (e.g., as shown in FIG. 1C) on the firearm optic 101. In this manner, as the adjustment cap assembly 100 is secured onto the adjustment post 103 of the firearm optic, the interface structure 114 contacts the adjustment screw 105 on the firearm optic to simultaneous rotate the adjustment screw 105 when the adjustment cap assembly is rotated.

Figured 2E depicts the outer surface 110 of the adjustment cap assembly 100. In some embodiments, the outer surface 110 is arcuate. In other embodiments, the outer surface 110 is another geometric shape, such as rectangular or asymmetrical.

Figure 2E:
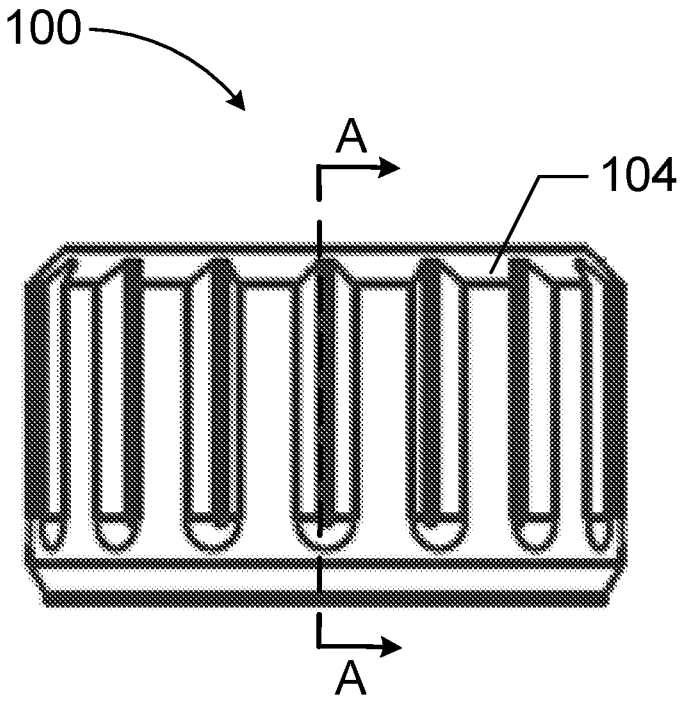
FIG. 2E is a side view of the adjustment cap assembly according to one or more embodiments of the disclosure.
Figure 3A:
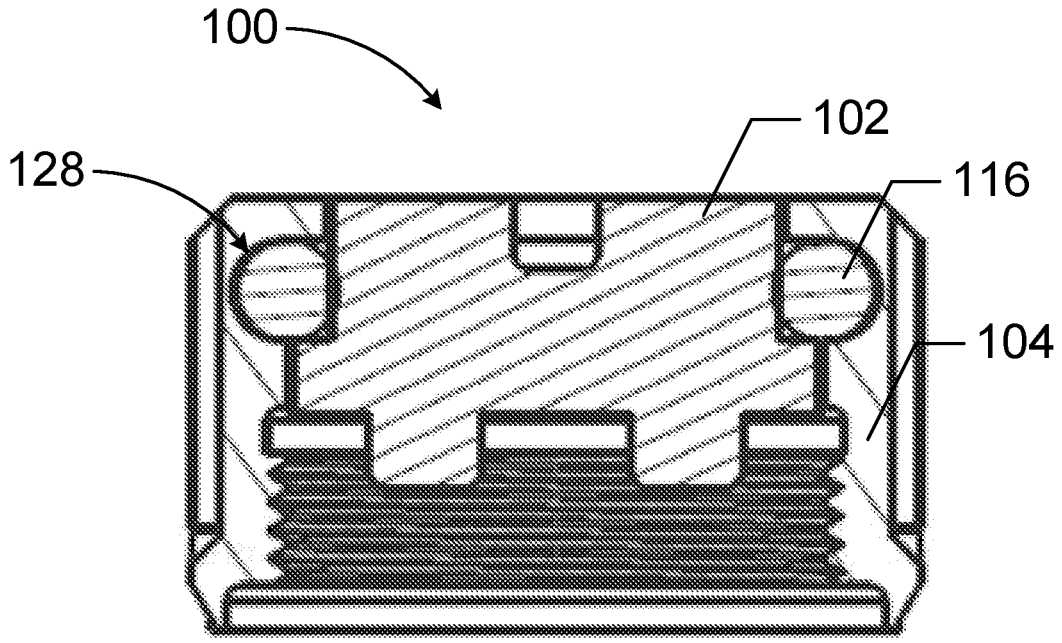
FIG. 3A is a cross-sectional view of an adjustment cap assembly according to one or more embodiments of the disclosure.
Figure 3B:
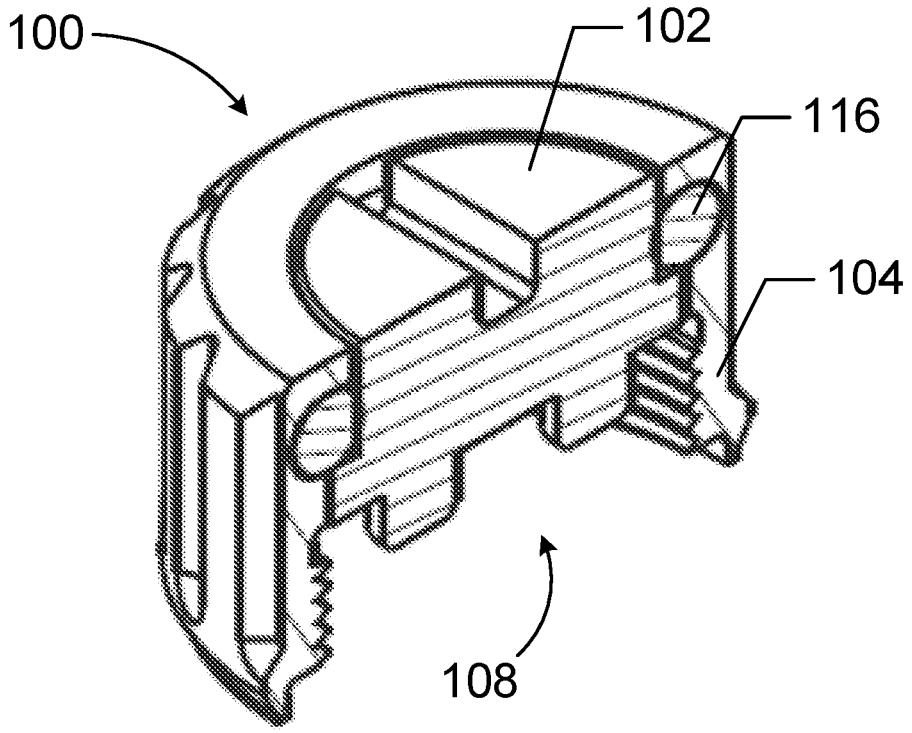
FIG. 3B is a perspective cross-sectional view of the adjustment cap assembly according to one or more embodiments of the disclosure.

As shown in FIG. 2E, A-A depicts the cross-sectional views of FIGS. 3A and 3B. As depicted by FIGS. 3A and 3B, the adjustment cap 100 includes the disc 102, an O-ring 116, and the sleeve 104. In this manner, the O-ring 116 slides onto the disc 102 and anchors into place within the sleeve 104. The disc 102, the O-ring 116, and the sleeve 104 are attached together to engage the firearm optic 101 (e.g., as shown in FIG. 1) via the inner surface 108 of the adjustment cap assembly 100. That is, the sleeve 104 may extend past the disc 102 to threadedly engage the firearm optic 101. For example, the interface structure 114 extends within the inner surface 108 away from the disc 102 to engage the firearm optic adjustment mechanism. In other embodiments, the sleeve 104 may engage the firearm optic 101 through another fastener, such as snaps, screws, or other securing mechanism.

Figure 4:
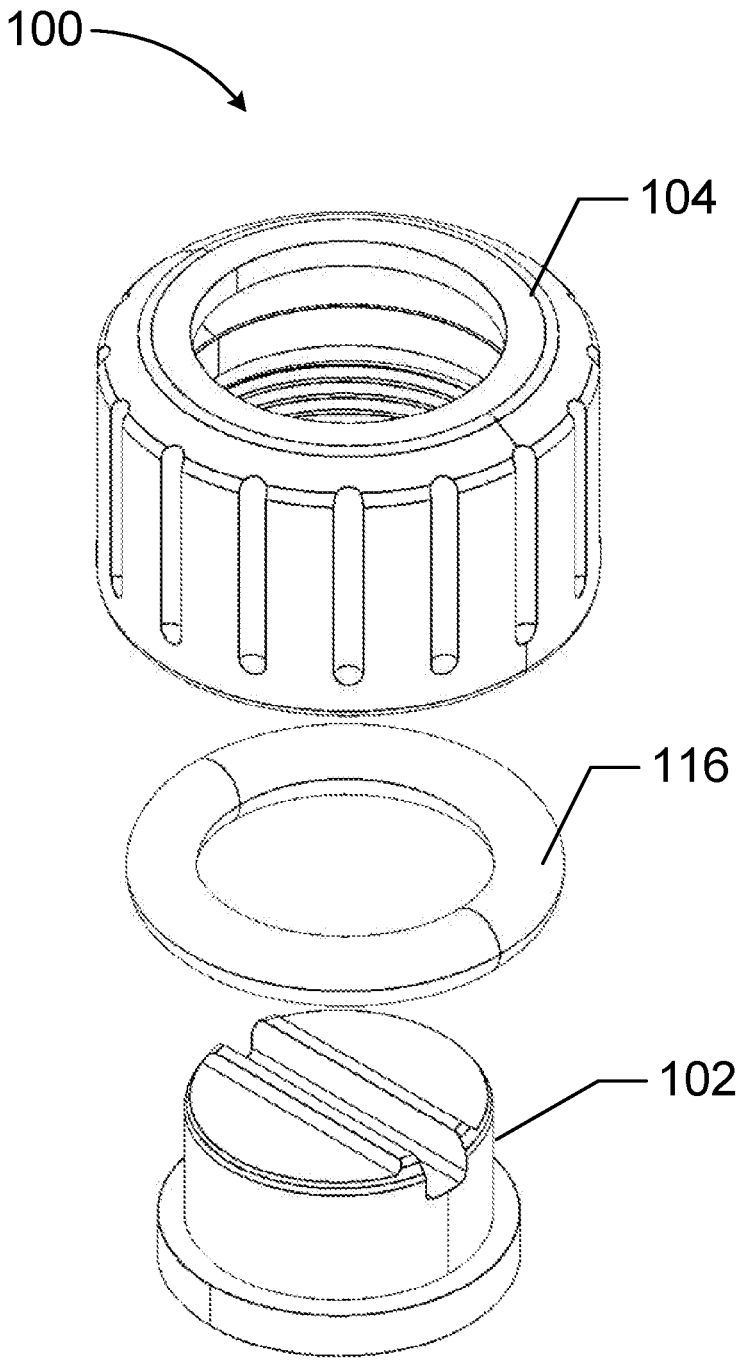
FIG. 4 is an exploded view of an adjustment cap assembly according to one or more embodiments of the disclosure.

FIG. 4 depicts the exploded view of the adjustment cap assembly 100. In some embodiments, the O-ring 116 is configured to slide onto the disc 102, and the disc 102 and O-ring secure within the sleeve 104. In other embodiments, the O-ring 116 secures within the sleeve and the disc 102 slides within the O-ring.

Figure 5A:
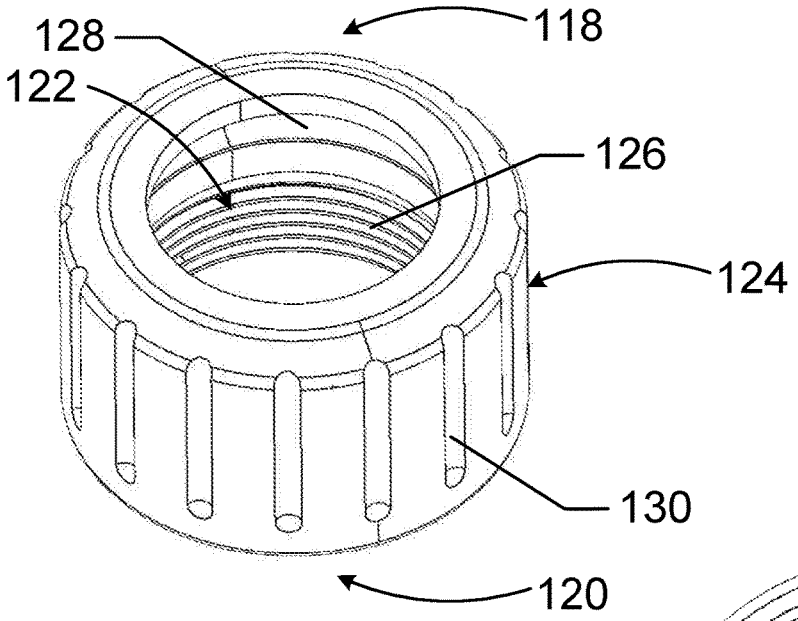
FIG. 5A is a perspective view of a sleeve according to one or more embodiments of the disclosure.
Figure 5B:
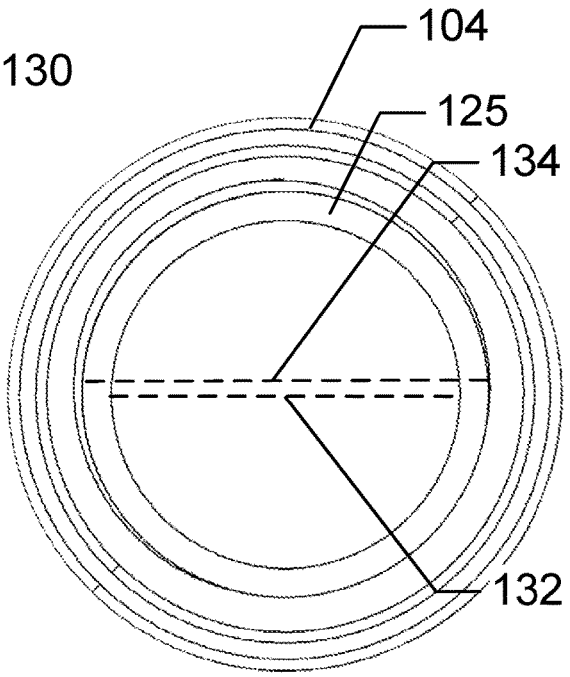
FIG. 5B is a bottom view of the sleeve according to one or more embodiments of the disclosure.
Figure 5C:
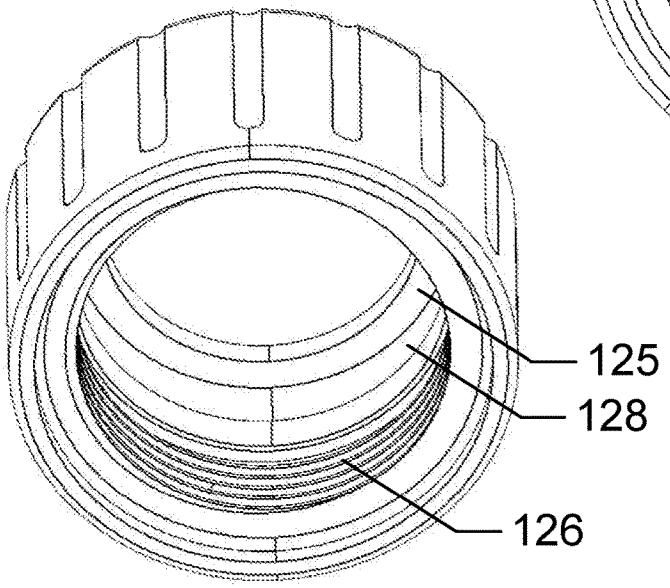
FIG. 5C is a bottom perspective view of the sleeve according to one or more embodiments of the disclosure.

FIGS. 5A-5C depict various views of the sleeve 104 of the adjustment cap assembly 100. The sleeve 104 includes a first end 118, a second end 120, an internal surface 122 and an external surface 124. The internal surface 122 includes threading 126 and one or more channels 128. The threading 126 is configured to receive the firearm optic's adjustment post (not shown). The one or more channels 128 are configured to receive the O-ring (e.g., as shown in FIG. 3A). In other embodiments, the internal surface 122 may include another type of fastening mechanism to secure onto the attachment post, such as a snap, screw, or other mechanism to secure the sleeve 104. The O-ring, sleeve, and disc may be permanently set in place or may be selectively removable to each other and/or to the attachment post of the firearm optic.

In some embodiments, the sleeve 104 includes a first interior diameter 132 and a second interior diameter 134. The diameters may be shown by a dashed line in FIG. 5B. In some instances, the first interior diameter 132 is shorter in length than the second interior diameter 134. In other instances, the first interior diameter 132 may be the same length or longer than the second interior diameter 134. The first interior diameter 132 may be configured to secure one end of the disc 102 within the sleeve 104 in combination with the O-ring 116 and one or more channels 128. Accordingly, when the assembly cap assembly 100 is set on the adjustment screw and adjustment post of the firearm optic, the disc 102 and the sleeve 104 may be operably secured together. In this manner, the disc 102 and the sleeve 104 may be configured to rotate about the adjustment post to rotate the adjustment screw. In some instances, the first interior diameter 132 may be located at the first end 118 and form a lip 125 around an interior diameter of the sleeve 104. In other instances, the lip 125 may be configured to prevent disc 102 from exiting out of the first end 118 of the sleeve. The lip 125 may form one side of the one or more channels 128.

The sleeve 104 includes a series of serrations 130 on the external surface 124 of the sleeve. The serrations 130 may be etched within the external surface. In this manner, the serrations 130 may provide grip to a user. In other embodiments, the serrations 130 may be gripped surface, such as knurling.

Figure 6A:
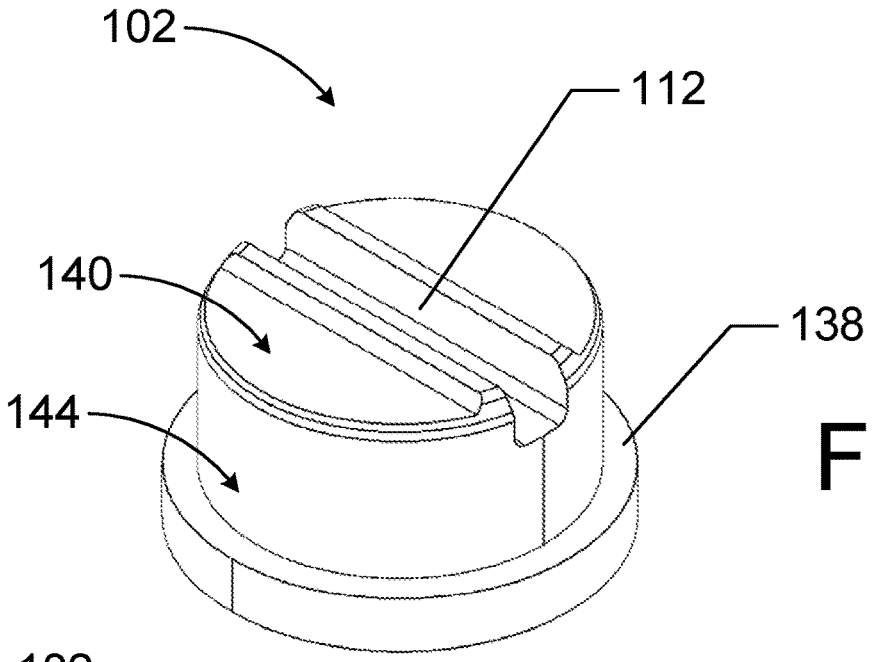
FIG. 6A is a perspective view of a disc according to one or more embodiments of the disclosure.
Figure 6B:
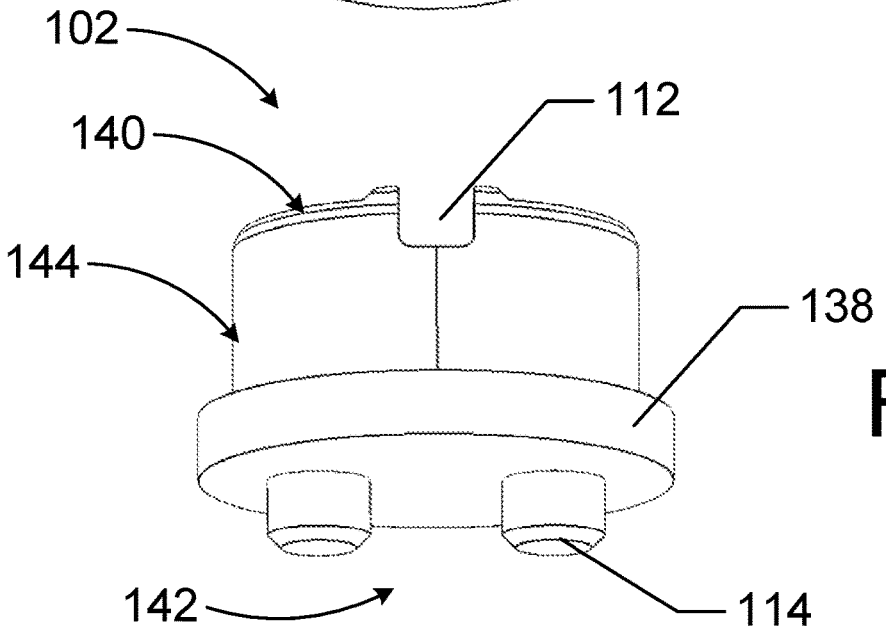
FIG. 6B is a side view of the disc according to one or more embodiments of the disclosure.

FIGS. 6A and 6B depict the disc 102 of the adjustment disc assembly 100. The disc 102 includes a top end 140, an opposed bottom end 142, and a side portion 144. The top end 140 includes the slot 112 configured to receive a tool that may rotate the adjustment cap assembly 100 on a firearm optic. In some instances, opposite the top end 140, the opposed bottom end 142 includes the interface structure 114 configured to engage the adjustment screw on the firearm optic 101. The interface structure 114 may be at least two pins with a cylindrical structure. In other instances, the interface structure may be a fin, a tongue, an offset pin, or other interface structure configured to engage an adjustment screw or adjustment mechanism of the firearm optic.

In some embodiments, the disc 102 includes a post 136 and a rim 138. That is, the post 136 is a cylindrical shape and the rim 138 protrudes about the post 136. In other embodiments, the rim 138 and the post 136 may be another geometric shape. The slot 112 is disposed on the top end 140 of the disc 102 to be exposed on the engagement surface 106 of the adjustment cap assembly 100. The slot 112 may be disposed on any one surface of the disc. In some instances, the O-ring slides within the sleeve, the disc slides within the O-ring, and the rim prevent the disc from sliding from within the sleeve. In this manner, the disc 102 may form a flush surface with the top end 140 and the lip 125.

Figure 7:
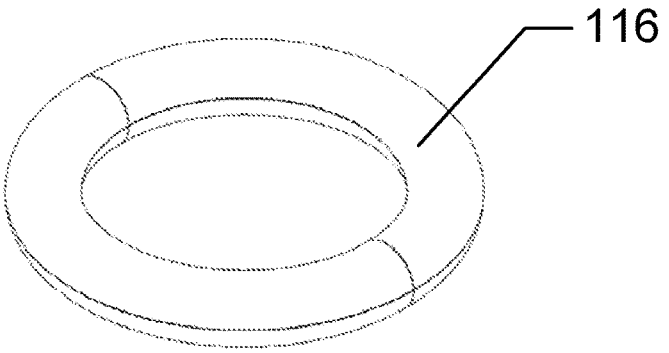
FIG. 7 is a perspective view of an O-ring according to one or more embodiments of the disclosure.

FIG. 7 depicts the O-ring 116. The O-ring 116 is configured to engage with the post 136 and the rim 138 of the disc 102. That is, the O-ring 116 slides along the post 136 to the rim 138. In some instances, the O-ring 116 may sit within the one or more channels 128 of the sleeve. In this manner, the O-ring 116 may be configured to be secure on the disc 102 within the sleeve 104. In some instances, the O-ring 116 may exert a force from the sleeve 104 onto the disc 102 thereby securing the disc within the sleeve. In addition, the O-ring 116 may help to keep the connection between the screw of the firearm optic 101 and the adjustment cap assembly to be watertight.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed is:

1. An adjustment cap assembly, comprising:
- a disc comprising an top end, an opposed bottom end, and a side portion;
- an O-ring disposed about the disc; and
- a sleeve configured to accept the disc and the O-ring within the sleeve, wherein the sleeve comprises:
  - an internal surface and an external surface;
  - a threading disposed on the internal surface; and
  - one or more channels disposed on the internal surface, wherein the one or more channels secures the O-ring and disc within the sleeve.

2. The adjustment cap of claim 1, wherein the sleeve comprises a series of serrations disposed on the external surface.

3. The adjustment cap of claim 1, wherein the sleeve comprises a first interior diameter and a second interior diameter, wherein the second interior diameter is greater in length than the first interior diameter.

4. The adjustment cap of claim 3, wherein the first interior diameter forms a lip configured to restrict movement of the O-ring.

5. The adjustment cap of claim 1, wherein the disc comprises a slot on the top end.

6. The adjustment cap of claim 1, wherein the disc comprises an interface structure on the opposed bottom end.

7. The adjustment cap of claim 1, wherein the disc is cylindrical.

8. The adjustment cap of claim 1, wherein the disc comprises:
- a post; and
- a rim extending away from the post.

9. An adjustment cap assembly, comprising:
- a sleeve with a first end, a second end, an internal surface, and an external surface, wherein the sleeve comprises:
  - a threading about the internal surface of the sleeve; and
  - one or more channels configured to anchor the disc and an O-ring within the sleeve; and
- a disc secured within the sleeve, the disc comprising:
  - a post;
  - a rim extending from the post; and
  - an interface structure disposed adjacent to the rim on the post.

10. The adjustment cap of claim 9, wherein the sleeve comprises a series of serrations disposed on the external surface.

11. The adjustment cap of claim 9, wherein the sleeve comprises a first interior diameter and a second interior diameter, wherein the second interior diameter is greater in length than the first interior diameter.

12. The adjustment cap of claim 9, wherein the disc comprises:
- an top end, an opposed bottom end, and a side portion;
- a slot disposed on the top end; and
- an interface structure on the opposed bottom end.

13. The adjustment cap of claim 12, wherein the interface structure comprises at least one stub extending from the opposed bottom end.

14. The adjustment cap of claim 1, wherein the sleeve comprises a first interior diameter and a second interior diameter, wherein the second interior diameter is equal in length to the first interior diameter.

15. The adjustment cap of claim 1, wherein the disc comprises:
- a slot disposed on the top end; and
- an interface structure on the opposed bottom end, wherein the interface structure comprises at least one stub extending from the opposed bottom end.

* * * * *